US008872049B2

(12) United States Patent
Yuan

(10) Patent No.: US 8,872,049 B2
(45) Date of Patent: Oct. 28, 2014

(54) TRIGGER LOCK-ON LOCK-OFF MECHANISM

(75) Inventor: Pedro Huang Bai Yuan, Huanggang (CN)

(73) Assignee: Milwaukee Electric Tool Corporation, Brookfield, WI (US)

( * ) Notice: Subject to any disclaimer, the term of this patent is extended or adjusted under 35 U.S.C. 154(b) by 97 days.

(21) Appl. No.: 13/449,402

(22) Filed: Apr. 18, 2012

(65) Prior Publication Data

US 2013/0277189 A1 Oct. 24, 2013

(51) Int. Cl.
*H01H 3/20* (2006.01)

(52) U.S. Cl.
USPC ..... 200/332

(58) Field of Classification Search
USPC ..... 200/332, 332.2, 522, 43.11, 43.13, 200/43.16, 43.17
See application file for complete search history.

(56) References Cited

U.S. PATENT DOCUMENTS 3,847,233 A * 11/1974 Glover et al. ..... 200/522
3,881,081 A 4/1975 Schilling et al.
4,033,077 A 7/1977 Chester et al.
4,276,459 A 6/1981 Willett et al.
4,280,026 A 7/1981 Alessio
4,879,438 A 11/1989 Winchester
4,934,494 A 6/1990 Fushiya et al.
5,170,851 A 12/1992 Kress et al.
5,201,146 A 4/1993 Fushiya
5,339,572 A 8/1994 Eicher
5,407,381 A 4/1995 Schaefer et al.
5,466,183 A 11/1995 Kirn et al.
5,579,902 A 12/1996 Kress
5,601,483 A 2/1997 Rudolf et al.
5,638,945 A 6/1997 Fukinuki et al.
5,644,112 A 7/1997 Geiger et al.
5,681,214 A 10/1997 Kleider et al.
5,824,982 A 10/1998 Kress
6,120,362 A 9/2000 Etter et al.
6,193,592 B1 2/2001 Grupe
6,259,047 B1 7/2001 Kimata et al.
6,274,828 B1 8/2001 Chu
6,293,859 B1 9/2001 Fink et al.
6,394,885 B2 5/2002 Georgiou
6,469,268 B1 10/2002 Schaeffeler et al.
6,602,122 B1 8/2003 Rudolf et al.
6,630,640 B1 10/2003 Schaeffeler et al.
6,686,548 B2 2/2004 Chen
6,700,091 B2 3/2004 Jones et al.
6,727,450 B2 4/2004 Schaeffeler et al.
6,752,705 B1 6/2004 Lin
6,794,593 B2 9/2004 Kraenzler et al.
6,812,425 B1 11/2004 Wong
6,861,598 B2 3/2005 Bascom et al.
6,864,448 B2 3/2005 Pozgay et al.
6,958,455 B1 10/2005 Lui
6,962,523 B2 11/2005 Fraser et al.
7,112,751 B2 9/2006 Turley
7,175,513 B2 2/2007 Folin
7,217,178 B2 5/2007 Oki et al.
7,232,970 B1 6/2007 Chen (Continued)

*Primary Examiner* — Vanessa Girardi
(74) *Attorney, Agent, or Firm* — Michael Best & Friedrich LLP

(57) ABSTRACT

A trigger mechanism for a power tool having a trigger and a locking mechanism, the trigger being moveable between an ON and an OFF position, the locking mechanism being moveable between a LOCKED-ON, a LOCKED-OFF and a NEUTRAL position.

20 Claims, 4 Drawing Sheets

(56) References Cited

U.S. PATENT DOCUMENTS

| | | | |
|---|---|---|---|
| 7,261,166 | B2 | 8/2007 | Baber et al. |
| 7,307,230 | B2 | 12/2007 | Chen |
| 7,311,588 | B1 | 12/2007 | Lin |
| 7,322,427 | B2 | 1/2008 | Shimma et al. |
| 7,507,925 | B2 | 3/2009 | Rudolf et al. |
| 7,537,065 | B2 | 5/2009 | Gallagher et al. |
| 7,544,116 | B1 | 6/2009 | Lin |
| 2002/0153237 | A1 | 10/2002 | Covell et al. |
| 2003/0094356 | A1 | 5/2003 | Waldron |
| 2003/0190877 | A1 | 10/2003 | Gallagher et al. |
| 2005/0136814 | A1 | 6/2005 | Rudolf et al. |
| 2006/0276114 | A1 | 12/2006 | Gallagher et al. |
| 2007/0108035 | A1 | 5/2007 | Broghammer |
| 2007/0187220 | A1 | 8/2007 | Chen |
| 2008/0085667 | A1 | 4/2008 | Lin |
| 2008/0142351 | A1 | 6/2008 | Gallagher et al. |
| 2008/0146126 | A1 | 6/2008 | Gallagher et al. |
| 2008/0146127 | A1 | 6/2008 | Gallagher et al. |
| 2009/0104861 | A1 | 4/2009 | Van Der Linde et al. |
| 2009/0152084 | A1 | 6/2009 | Hofer et al. |
| 2010/0009608 | A1 | 1/2010 | Lo et al. |
| 2010/0175972 | A1 | 7/2010 | Kimata et al. |

* cited by examiner

TRIGGER LOCK-ON LOCK-OFF MECHANISM

BACKGROUND

The present invention relates generally to power tools and, more specifically, to triggers for power tools.

Power tools can be dangerous if accidentally turned on. In addition, some power tools are used for extended periods and thus it is desirable to have a trigger that stays in the ON position to reduce operator fatigue. At the same time, it is important that the trigger be easily moved to the OFF position.

SUMMARY

In one embodiment, the invention provides a trigger mechanism for a power tool including a trigger having an aperture in an internal portion thereof, the trigger being moveable in a first direction to move the trigger to an ON position, the trigger being movable in a second direction to move the trigger to an OFF position. The trigger mechanism also includes an electrical switch for activation by movement of the trigger between the ON and OFF positions to close and open an electrical circuit; and a locking mechanism moveable by the user in a third direction to unlock the trigger from the OFF position and being moveable by the user an additional distance in the third direction to position a portion of the locking mechanism in the aperture to lock the trigger in the ON position.

In another embodiment the invention includes a power tool having a housing; a motor disposed in an interior portion of the housing; and a working element selectively driven by the motor. The invention further includes a trigger having an aperture in an internal portion thereof, the trigger being moveable in a first direction to move the trigger to an ON position, the trigger being movable in a second direction to move the trigger to an OFF position; and an electrical switch selectively activated by movement of the trigger between the ON and OFF positions to turn the motor ON and OFF. Finally, the invention also has a locking mechanism moveable by the user in a third direction to unlock the trigger from the OFF position and being moveable by the user an additional distance in the third direction to position a portion of the locking mechanism in the aperture to lock the trigger in the ON position.

In another embodiment the invention provides a method of locking a trigger for a power tool in an ON position, the method including providing a trigger having an aperture in an internal portion thereof, the trigger being movable in a first direction to move the trigger to the ON position and in a second direction to move the trigger to the OFF position; moving a locking mechanism in a third direction to unlock the trigger from the off position; moving the trigger in the first direction to place the trigger in the ON position; and holding the trigger in the ON position. The method also includes the steps of moving the locking mechanism an additional distance in the third direction to place the locking mechanism in a locked-on position; holding the locking mechanism in the locked-on position; and releasing the trigger and the locking mechanism so that the locking mechanism holds the trigger in the ON position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
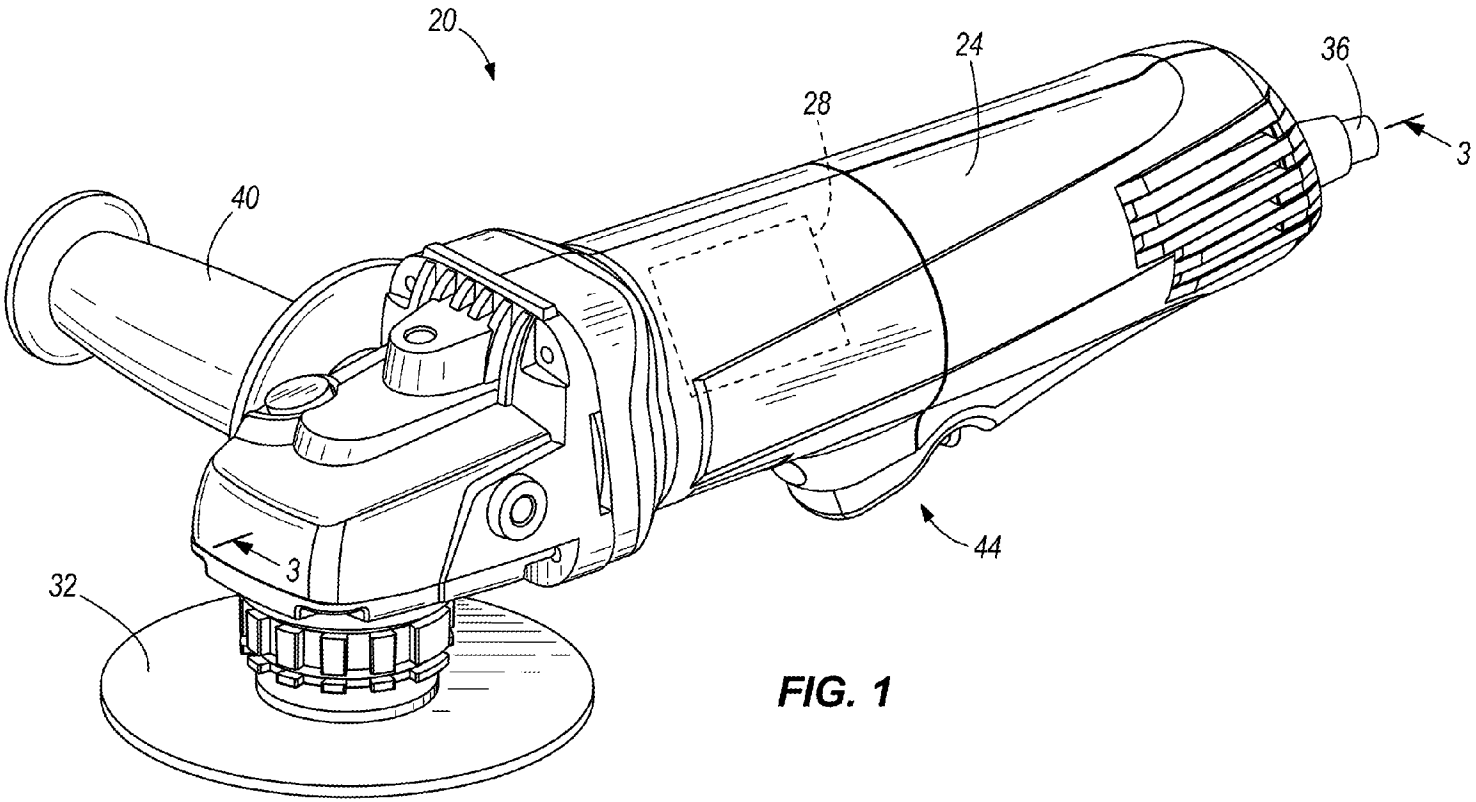
FIG. 1 is a perspective view of a power tool.

FIG. 1 illustrates a power tool 20, specifically an angle grinder. The power tool 20 includes a housing 24 which may be gripped by an operator. Disposed in the interior of the housing 24 is a motor 28 which is used to drive a working element 32, the working element 32 being useful for modifying an object. In the illustrated embodiment the working element is an abrasive disc, but other types of power tools contemplated herein will use different working elements. An electrical cord 36 is coupled to the housing 24, the electrical cord 36 also being electrically coupled to the motor 28 to provide electrical power for the motor 28. While the illustrated embodiment shows an electrical cord 36, the invention may be used with a cordless power tool wherein electrical power is provided by a battery such as a lithium ion battery, a ni-cad battery, or the like. An auxiliary grip 40 is coupled to the housing 24 and may be used by the operator to hold the power tool 20. A trigger mechanism 44 is disposed on the housing 24 of the power tool 20. While the illustrated embodiment shows an angle grinder, other power tools such as a sander, a drill, a sawzall, a router, a circular saw, a miter saw, a paint sprayer, etc. may be used with the trigger mechanism 44 described herein.

Figure 2:
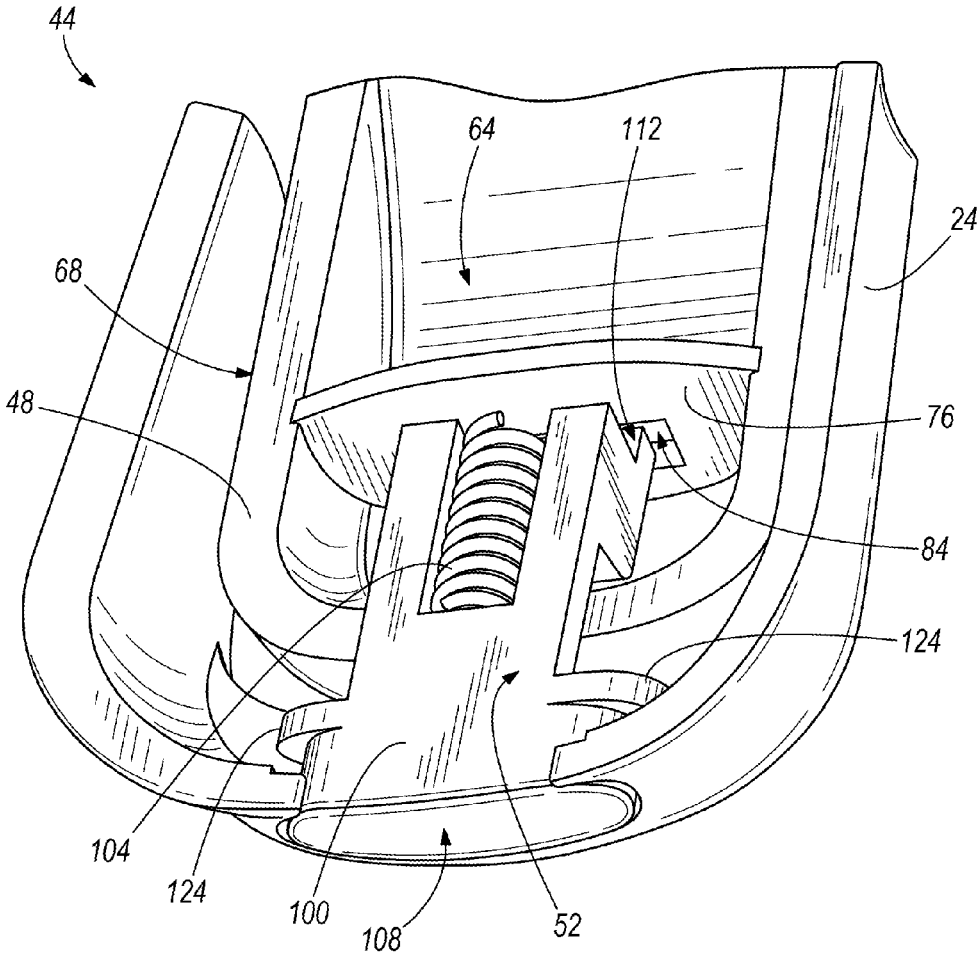
FIG. 2 is a perspective view of a trigger mechanism of the power tool of FIG. 1.

The trigger mechanism 44, illustrated in FIG. 2, is coupled to the housing 24. In the illustrated embodiment the trigger mechanism 44 is disposed on a lower portion of the housing 24, but in other embodiments the trigger mechanism 44 may be disposed on an upper or a side portion of the housing 24. The trigger mechanism 44 includes a trigger 48, a locking mechanism 52, and an electrical switch 56 (shown in FIG. 3).

The trigger 48 in the illustrated embodiment is a paddle-type trigger, although other types of triggers, such as a sliding trigger or a toggle trigger, are contemplated for use with the power tool 20. The trigger 48 is coupled to the housing 24 such that a first end 60 is moveable with respect to the housing 24. The trigger 48 includes an interior portion 64 and an exterior portion 68, the exterior portion 68 being accessible to the operator. The first end 60 of the trigger 48 may move in a first direction towards the housing 24. The first end 60 may move in a second direction, the second direction being opposite of the first direction, away from the housing 24. The trigger 48 is coupled to the housing 24 such that it is inhibited from moving in other directions. Ribs 72 may be disposed in the interior of the trigger 48 to give the trigger strength. In the illustrated embodiment the trigger 48 is made of plastic, but other materials are contemplated. A locking rib 76 is disposed in the interior of the trigger 48, the locking rib 76 being an integral part of the trigger 48. The trigger 48 may also include a pushing rib 80, the pushing rib 80 being sized and configured to contact the electrical switch 56. In an alternative embodiment the locking rib 76 is sized and configured to contact the electrical switch 56 such that the pushing rib 80 is not needed.

In the illustrated embodiment the locking rib 76 has a rectangular aperture 84 disposed therein; other embodiments may include the aperture 84 having a different shape such as an oval, a square, or an irregular shape. An edge 88 disposed proximate to the aperture 84 is beveled towards a first side 92 of the locking rib. The edge 88 forms an approximately ninety degree angle with a second side 96 of the locking rib 76.

The trigger mechanism 44 is slidingly coupled to the housing 24 and includes a lock button 100 and a biasing member 104. A first end 108 is exposed to the operator and may be pushed by the operator. A second end 112 is disposed in the interior of the trigger 48. The second end 112 is sized and configured to enter and interface with the aperture 84 on the locking rib 76. The second end 112 also includes an angled portion 116, best seen in FIG. 3, the angled portion 116 being angled towards the housing 24. A recess 120 is disposed on the lock button 100 to house the biasing member 104. An opening 122 is disposed on the lock button 100 between the first end 108 and the second end 112, the opening 122 being sized and configured to selectively receive the first end 60 of the trigger 48. The biasing member 104 pushes on the locking rib 76 and the lock button 100 such that the locking rib 76 and the lock button 100 are biased apart. Wings 124 are disposed on the locking button 100 to prevent the lock button 100 from being pushed out of the housing 24 by the biasing member 104. The trigger mechanism 44 may be moved in a third direction, the third direction being away from the working element 32. The trigger mechanism 44 may also be moved in a fourth direction, the fourth direction being opposite of the third direction. The locking trigger mechanism 44 is constrained by the trigger 48 and the housing 24 so that it is inhibited from moving in other directions. In the illustrated embodiment the lock button 100 is made of plastic, but other materials are contemplated.

The electrical switch 56 is coupled to the housing 24 between the interior portion 64 of the trigger 48 and the housing 24. The electrical switch 56 includes an arm 128 which is coupled to a cylinder 132 such that the arm 128 is able to rotate with respect to the cylinder 132. Electrical contacts 136 are disposed in the interior of the cylinder 132 and move between an OPEN and CLOSED position depending on the position of the arm 128. When the electrical contacts 136 are in the OPEN position electrical current is not supplied to the motor 28. When the electrical contacts 136 are in the CLOSED position electrical current is supplied to the motor 28. A biasing member 140 is disposed in the interior of the cylinder 132 and is configured to bias the arm 128 away from the housing 24. In an alternative embodiment a biasing member may be disposed between the housing 24 and the arm 128, the biasing member being configured to bias the arm 128 away from the housing 24.

FIGS. 3-6 illustrate the trigger 48 and the locking mechanism 52 in various positions. The trigger 48 is movable between an ON position and an OFF position. The locking mechanism 52 is movable between a LOCKED-OFF position, a NEUTRAL position, and a LOCKED-ON position. The various positions and functions associated with these positions will be described.

Figure 3:
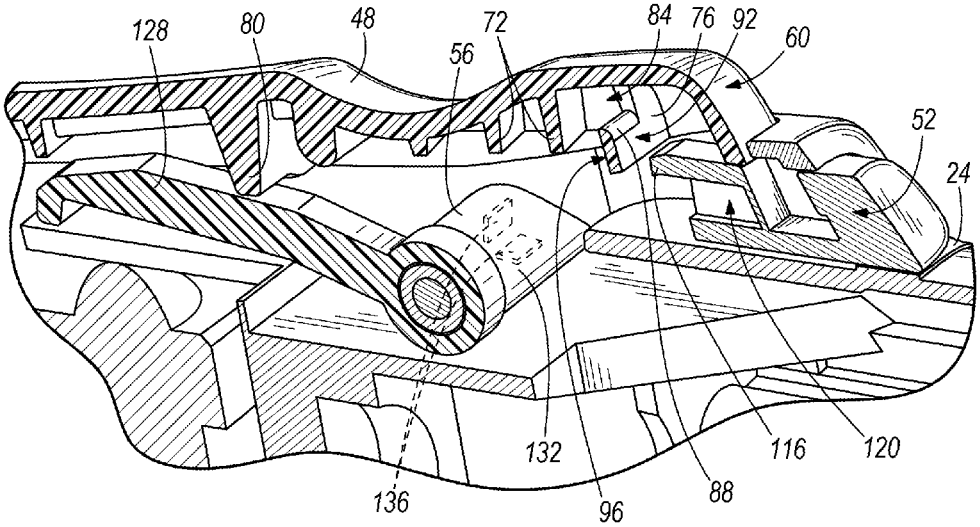
FIG. 3 is a partial section view of the power tool of FIG. 1, taken along line 3-3, showing a trigger in an OFF position and a lock button in a LOCKED-OFF position.

FIG. 3 illustrates the trigger 48 in the OFF position and the locking mechanism 52 in the LOCKED-OFF position. When the trigger 48 is in the OFF position the first end 60 of the trigger 48 is rotated away from the housing 24, the electrical contacts 136 are in the OPEN position such that electrical current is not supplied to the motor 28 and the working element 32 is not powered. The biasing member 140 biases the arm 128 away from the housing 24 and the arm 128 thus biases the first end 60 away from the housing. When the locking mechanism 52 is in the LOCKED-OFF position, the locking mechanism 52 prevents the trigger 48 from being moved to the ON position due to interference between the first end 60 and the lock button 100. Thus if the operator attempts to move the trigger 48 to the ON position while the locking mechanism 52 is in the LOCKED-OFF position, the lock button 100 inhibits the trigger 48 from being moved to the ON position. As has been described above, the locking mechanism 52 is biased towards the LOCKED-OFF position and the trigger 48 is biased towards the OFF position.

The positions shown in FIG. 3 are the default positions that the trigger 48 and locking mechanism 52 should be placed in when the power tool 20 is not being used. In order to move the locking mechanism 52 from the LOCKED-OFF position shown in FIG. 3 to the NEUTRAL position shown in FIG. 4, the operator pushes the first end 108 of the lock button 100 in the third direction with sufficient force to overcome the biasing force exerted by the biasing member 104.

Figure 4:
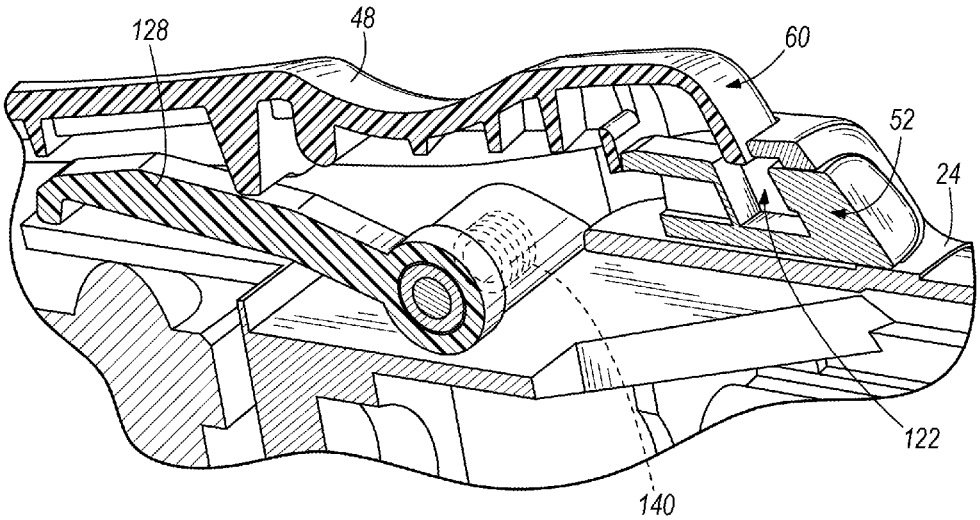
FIG. 4 is a partial section view of the power tool of FIG. 1, taken along line 3-3, showing the trigger in the OFF position and the lock button in an UNLOCKED position.

FIG. 4 illustrates the trigger 48 in the OFF position and the locking mechanism 52 in the NEUTRAL position. The function of the trigger 48 in the OFF position has been described with respect to FIG. 3. When the locking mechanism 52 is in the NEUTRAL position, the first end 60 of the trigger 48 may pass into the opening 122 if the operator presses the trigger 48 in the first direction. As described above, the biasing member 140 in the electrical switch 56 biases the arm 128 in the second direction, the arm 128 then biasing the trigger 48 in the second direction into the OFF position. When the locking mechanism 52 is in the NEUTRAL position, the second end 108 of the lock button 100 has not passed into the aperture 84 disposed on the locking rib 76.

The positions shown in FIG. 4 are the positions that the trigger 48 and locking mechanism 52 are in when the operator is preparing to use the power tool 20. In order to move the trigger 48 from the OFF position as shown in FIG. 4 to the ON position shown in FIG. 5, the operator must press the first end 60 of the trigger 48 in the first direction with sufficient force to overcome the biasing force exerted by the biasing member 140.

Figure 5:
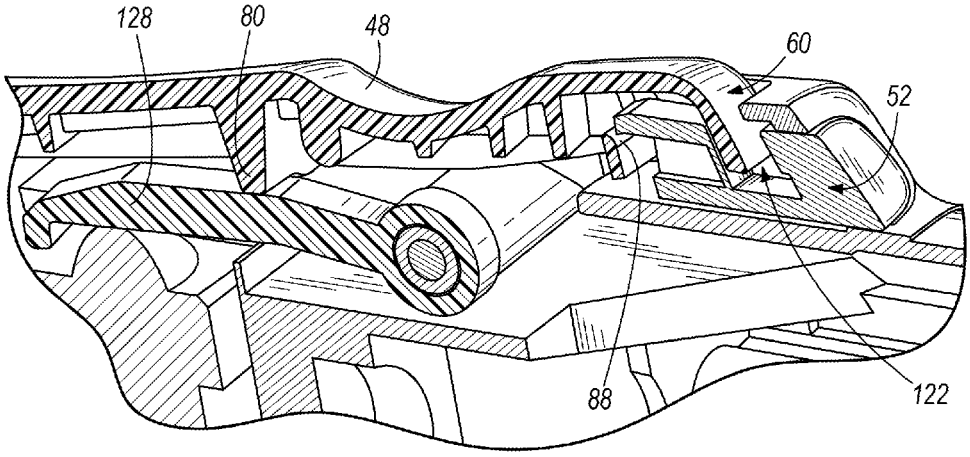
FIG. 5 is a partial section view of the power tool of FIG. 1, taken along line 3-3, showing the trigger in an ON position and the lock button in the UNLOCKED position.

FIG. 5 illustrates the trigger 48 in the ON position and the locking mechanism 52 in the NEUTRAL position. When the trigger 48 is in the ON position, the first end 60 of the trigger 48 passes into the opening 122 on the locking mechanism 52 and the pushing rib 80 moves the arm 128 in the first direction, thus moving the electrical contacts 140 to the CLOSED position which thus allows electrical current to pass to the motor 28. If the trigger 48 is in the ON position and the locking mechanism 52 is in the NEUTRAL position, and the operator releases the trigger 48, then the trigger 48 will move in the second direction which will result in the trigger 48 being in the OFF position. Thus when the locking mechanism 52 is in the NEUTRAL position as shown in FIGS. 4-5, the trigger 48 may move between the ON and OFF positions.

The position of the trigger 48 and the locking mechanism 52 shown in FIG. 5 are used when the operator wants to use the power tool 20 for a short period, or when the operator wants to quickly move the trigger 48 between the ON and OFF positions. In order for the trigger 48 to remain in the position shown in FIG. 5, the operator must exert a force on the trigger 48 in the first direction sufficient to keep the trigger 48 in the ON position. In order to move the locking mechanism 52 from the NEUTRAL position shown in FIG. 5 to the LOCKED-ON position shown in FIG. 6, the user must exert a force on the first end 108 in the third direction sufficient to overcome the force exerted by the biasing member 104 while holding the trigger 48 in the ON position. The beveling between the edge 88 and the first side 92 of the locking rib 76 helps the second end 112 of the trigger mechanism 44 move easily into the aperture 84. Once the trigger mechanism 44 has been moved in the third direction a distance which allows the second end 112 to pass into the aperture 84, the operator releases the trigger 48. Once the trigger 48 is released, the trigger mechanism 44 holds the trigger 48 in the ON position.

Figure 6:
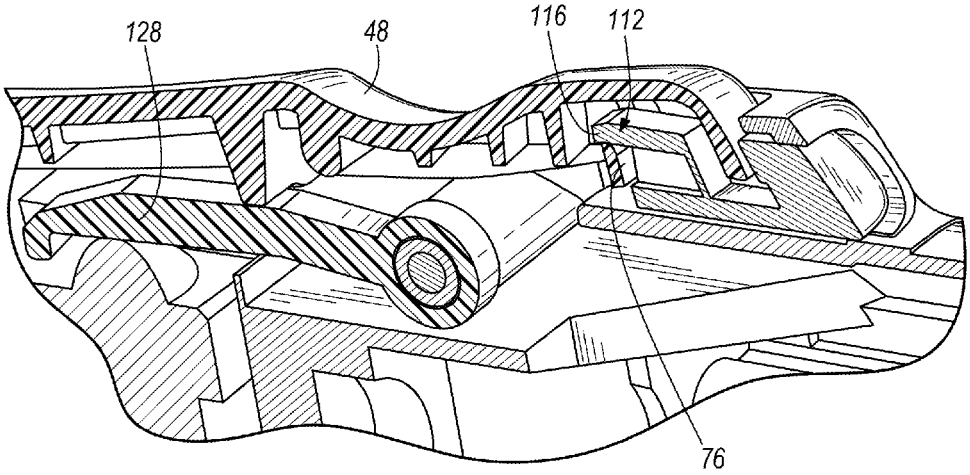
FIG. 6 is a partial section view of the power tool of FIG. 1, taken along line 3-3, showing the trigger in the ON position and the lock button in a LOCKED position.

FIG. 6 illustrates the trigger 48 in the ON position and the trigger mechanism 44 in the LOCKED-ON position. When the trigger 48 is in the ON position and the trigger mechanism 44 is in the LOCKED-ON position, the second end 112 of the trigger mechanism 44 has passed into the aperture 84. The angled portion 116 contacts the edge 88 and second side 96 of the locking rib 76, serving to keep the trigger mechanism 44 in the LOCKED-ON position. The friction between the second end 112 of the trigger mechanism 44 and the locking rib 76 overcomes the force exerted by the biasing member 104, resulting in the trigger mechanism 44 being inhibited from leaving the LOCKED-ON position. The second end 112 of the trigger mechanism 44 also serves to inhibit the trigger 48 from moving in the second direction, thus keeping the trigger 48 in the ON position.

The position of the trigger 48 and the trigger mechanism 44 illustrated in FIG. 6 is useful when the operator wishes to use the power tool 20 for an extended period or when the operator wishes to use his hands away from the trigger 48 while the power tool 20 is running. In order to move the trigger 48 and the trigger mechanism 44 from the position shown in FIG. 6 to the position shown in FIG. 3, the operator must push the trigger 48 in the first direction which creates a space between the trigger mechanism 44 and the locking rib 76. When the space is created between the trigger mechanism 44 and the locking rib 76, the biasing member 104 forces the trigger mechanism 44 to move in the fourth direction moving the trigger mechanism 44 to the NEUTRAL position. The trigger mechanism 44 remains in the NEUTRAL position while the operator is holding the trigger 48 in the ON position as the first end 60 of the trigger 48 inhibits the trigger mechanism 44 from moving to the LOCKED-OFF position. After pushing the trigger 48 in the first direction, the operator then releases the trigger 48. The biasing member 140 in the electrical switch 56 biases the arm 128 and thus the trigger 48 in the second direction, moving the trigger 48 to the OFF position. When the trigger 48 moves to the OFF position the first end 60 of the trigger 48 is no longer in contact with the trigger mechanism 44 which allows the biasing member 104 to move the trigger mechanism 44 in the fourth direction, thus moving the trigger mechanism 44 to the LOCKED-OFF position.

Thus, the invention provides, among other things, a power tool having a trigger with LOCK-ON, LOCK-OFF and NEUTRAL positions. Various features and advantages of the invention are set forth in the following claims.

What is claimed is:

1. A trigger mechanism for a power tool comprising:

a trigger defining an interior portion, the trigger including a rib extending from the interior of the trigger, the trigger being moveable in a first direction to move the trigger to an ON position, the trigger being movable in a second direction to move the trigger to an OFF position;

an electrical switch for activation by movement of the trigger between the ON and OFF positions to close and open an electrical circuit; and a locking mechanism defining a recess and an opening, the locking mechanism moveable by the user in a third direction to unlock the trigger from the OFF position and being moveable by the user an additional distance in the third direction to receive the rib at least partially within the recess and to receive a portion of the trigger within the opening to lock the trigger in the ON position.

2. The trigger mechanism of claim 1 wherein the locking mechanism is configured so that as the user pushes a first end of the locking mechanism in the third direction, a second end of the locking mechanism enters the aperture.

3. The trigger mechanism of claim 1 wherein the locking mechanism selectively prevents the trigger from moving to the ON position.

4. The trigger mechanism of claim 3 wherein the locking mechanism has an opening thereon, a portion of the trigger passing into the opening when the locking mechanism is moved in the third direction and the trigger is moved in the first direction.

5. The trigger mechanism of claim 1 wherein the trigger is moveable in the first direction to unlock the trigger from the ON position.

6. The trigger mechanism of claim 5 further comprising a biasing member, the biasing member being configured to bias the trigger towards the OFF position.

7. The trigger mechanism of claim 6 wherein the biasing member is coupled to the electrical switch.

8. The trigger mechanism of claim 6 wherein the locking mechanism includes a second biasing member to bias the locking mechanism in a fourth direction, the fourth direction being opposite to the third direction.

9. A method of locking a trigger for a power tool in an ON position comprising:

providing a trigger, including a rib extending from an interior of the trigger, the trigger being movable in a first direction to move the trigger to the ON position and in a second direction to move the trigger to the OFF position;

moving a locking mechanism in a third direction to unlock the trigger from the off position, the locking mechanism defining a recess and an opening;

moving the trigger in the first direction to place the trigger in the ON position;

holding the trigger in the ON position;

moving the locking mechanism an additional distance in the third direction to place the locking mechanism in a locked-on position wherein at least a portion of the recess receives the rib, and the opening receives a portion of the trigger;

holding the locking mechanism in the locked-on position; and releasing the trigger and the locking mechanism so that the locking mechanism holds the trigger in the ON position.

10. The method of claim 9 further comprising biasing the locking mechanism in a fourth direction using a biasing member, wherein the fourth direction is opposite of the third direction.

11. The method of claim 9 further comprising moving the trigger in the first direction to release the locking mechanism from the locked-on position.

12. The method of claim 11 further comprising biasing the trigger in the second direction using a biasing member.

13. A power tool comprising:

a housing including a first half and a second half, the first half and the second half are defined by a horizontal plane through the housing;

a motor disposed in an interior portion of the housing;

a working element selectively driven by the motor;

a trigger disposed on the first half of the housing, the trigger pivotally coupled to the housing and having an aperture formed as part of an internal portion thereof, the trigger being pivotable in a first direction to move the trigger to an ON position, the trigger being pivotable in a second direction to move the trigger to an OFF position;

an electrical switch selectively activated by the pivot movement of the trigger between the ON and OFF positions to turn the motor ON and OFF; and a locking mechanism adjacent the trigger and disposed on the first half, the locking mechanism moveable by the user in a third direction to unlock the trigger from the OFF position and being moveable by the user an additional distance in the third direction to position a portion of the locking mechanism into engagement with the aperture to lock the trigger in the ON position.

14. The power tool of claim 13, wherein the locking mechanism is configured so that as the user pushes a first end of the locking mechanism in the third direction, a second end of the locking mechanism enters the aperture.

15. The power tool of claim 13 wherein the locking mechanism selectively prevents the trigger from moving to the ON position.

16. The power tool of claim 13 wherein the working element is an abrasive disc.

17. The power tool of claim 13 wherein the trigger is moveable in the first direction to unlock the trigger from the ON position.

18. The power tool of claim 17 further comprising a biasing member configured to bias the trigger towards the OFF position.

19. The power tool of claim 18 wherein the biasing member is coupled to the electrical switch.

20. The power tool of claim 18 wherein the locking mechanism includes a biasing member to bias the locking mechanism in a fourth direction, the fourth direction being opposite to the third direction.

* * * * *